US011123763B2

(12) United States Patent
Xu et al.

(10) Patent No.: US 11,123,763 B2
(45) Date of Patent: Sep. 21, 2021

(54) COLOR REGISTER EDGING METHOD FOR ALUMINUM ALLOY HUB

(71) Applicant: CITIC Dicastal CO., LTD, Qinhuangdao (CN)

(72) Inventors: Zuo Xu, Qinhuangdao (CN); Guangcai Chen, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 358 days.

(21) Appl. No.: 16/188,614

(22) Filed: Nov. 13, 2018

(65) Prior Publication Data

US 2019/0160489 A1 May 30, 2019

(30) Foreign Application Priority Data

Nov. 30, 2017 (CN) ..... 201711235354.4

(51) Int. Cl.

| | |
|---|---|
| ***B05D 3/00*** | (2006.01) |
| ***B05D 5/06*** | (2006.01) |
| ***B05D 7/14*** | (2006.01) |
| ***B05D 7/00*** | (2006.01) |
| ***B05D 3/10*** | (2006.01) |
| *B05D 1/06* | (2006.01) |
| *B05D 1/12* | (2006.01) |

(52) U.S. Cl.

CPC ..... *B05D 3/002* (2013.01); *B05D 3/007* (2013.01); *B05D 3/102* (2013.01); *B05D 5/06* (2013.01); *B05D 5/066* (2013.01); *B05D 7/14* (2013.01); *B05D 7/142* (2013.01); *B05D 7/576* (2013.01); *B05D 1/06* (2013.01); *B05D 1/12* (2013.01); *B05D 2202/25* (2013.01); *B05D 2451/00* (2013.01)

(58) Field of Classification Search

None

See application file for complete search history.

(56) References Cited

U.S. PATENT DOCUMENTS

| | | | | |
|---|---|---|---|---|
| 2006/0019089 | A1 | 1/2006 | Leininger | |
| 2006/0188652 | A1 | 8/2006 | Tansey et al. | |
| 2006/0188655 | A1 | 8/2006 | Reising et al. | |
| 2015/0284869 | A1* | 10/2015 | Wang | B05B 5/032 204/510 |
| 2017/0016106 | A1 | 1/2017 | Zhang et al. | |

FOREIGN PATENT DOCUMENTS

| | | | |
|---|---|---|---|
| CN | 106733551 | A | 5/2017 |

* cited by examiner

*Primary Examiner* — Shamim Ahmed
*Assistant Examiner* — Bradford M Gates
(74) *Attorney, Agent, or Firm* — Calfee, Halter & Griswold LLP

(57) ABSTRACT

The present application provides a color register edging method for an aluminum alloy hub. The method is characterized by comprising the following steps: (I) a first pretreatment and drying step, including washing, degreasing, acid pickling and passivation; (II) a body powder and paint spraying and respective curing step; (III) a second pretreatment and drying step, including washing, degreasing, acid pickling and passivation; (IV) an edging color register spraying and curing step, wherein a color register paint is squeezed onto a surface that needs color register by using an injection needle; (V) a third pretreatment and drying step, including washing, degreasing, acid pickling and passivation; and (VI) a high-gloss transparent powder spraying and curing step. The method breaks the conventional shielded protective color register process, the designed grooves can be in a full circle or partial, meanwhile, the size of the grooves can also be changed in the width.

10 Claims, No Drawings

COLOR REGISTER EDGING METHOD FOR ALUMINUM ALLOY HUB

CROSS-REFERENCE TO RELATED APPLICATIONS

This application claims priority to Chinese Patent Application No. 201711235354.4, filed on Nov. 30, 2017, which is hereby incorporated by reference in its entirety.

TECHNICAL FIELD

The present application relates to the technical field of automobile parts, specifically to a color register edging method for an aluminum alloy hub.

BACKGROUND ART

Aluminum wheel hubs are important exterior parts of automobiles, and their external beauty and color match directly attract the attention of consumers. With people's demand for the use of automobiles, the personalization and differentiation of wheel appearance have become the focus of everyone's attention. The fashion and dynamics of wheel hubs have become a mainstream of the times.

However, when edging is performed on other paint of a wheel, the sprayed area of the edged paint is narrow and the condition is complicated, so it is difficult to obtain an edged paint surface with high fastness. The existing shielded color register spraying process has the problems of low production efficiency, low qualification rate, unclear boundary of the color register part, high labor intensity and the like.

SUMMARY OF THE INVENTION

Accordingly, the purpose of the present application is to provide a uniform color register edging method for an aluminum alloy hub.

In one aspect of the present application, provided is a color register edging method for an aluminum alloy hub, characterized by including the following steps: (I) a first pretreatment and drying step, including washing, degreasing, acid pickling and passivation; (II) a body powder and paint spraying and respective curing step; (III) a second pretreatment and drying step, including washing, degreasing, acid pickling and passivation; (IV) an edging color register spraying and curing step, wherein a color register paint is squeezed onto a surface that needs color register by using an injection needle; (V) a third pretreatment and drying step, including washing, degreasing, acid pickling and passivation; and (VI) a high-gloss transparent powder spraying and curing step.

In a preferred aspect of the present application, in steps I, III and V, the first, second and third pretreatment and drying steps sequentially include the processes of: washing, pre-degreasing, degreasing, washing, acid pickling, washing, passivation, washing, closing, washing and drying.

In a preferred aspect of the present application, in step II, an electrostatic powder gun is adopted for spraying body powder, the distance between the electrostatic powder gun and the surface of a wheel is 200-300 mm, the throughput of the electrostatic powder gun is 2.5-4.5 $m^3$/h, the atomizing pressure is 3.0-4.0 bar, the electrostatic pressure is controlled at 50-70 KV, the front spray thickness is 120-160 μm, the body powder curing temperature is 175-185° C., and the holding time is 20-25 min.

In a preferred aspect of the present application, in step II, an air spray gun is adopted for spraying paint, the distance between the air spray gun and the surface of the wheel is 180-250 mm, the throughput of the air spray gun is 60-100 mL/min, the atomizing pressure is 2.0-3.0 bar, the sector pressure is 2.0-3.0 bar, the paint spray thickness is 10-20 μm, the temperature of the wheel workpiece is 40-50° C., the paint curing temperature is 145-150° C., and the holding time is 15-25 min.

In a preferred aspect of the present application, in edging color register spraying of step IV, the injection needle has a caliber of 1.5 mm, the hub is horizontally placed on an automatic rotary table, and the needle is fixed on an adjustable bracket.

In a preferred aspect of the present application, the distance between the needle and the sprayed surface of the wheel is 4-6 mm, the flow rate of the injected paint is 10-20 mL/min, the power of the automatic rotary table is 56.6 Hz, and the air pressure of a closed paint supply system is 2.0-3.0 bar.

In a preferred aspect of the present application, in step VI, a electrostatic spraying is adopted in the high-gloss transparent powder spraying process, the distance between the electrostatic powder gun and the surface of the wheel is 200-300 mm, the throughput of the electrostatic powder gun is 2.5-3.5 $m^3$/h, the atomizing pressure is 1.5-2.5 bar, the electrostatic pressure is controlled at 40-60 KV, the front spray thickness is about 80-120 μm, the transparent powder curing temperature is 177-180° C., and the holding time is 15-22 min.

In a preferred aspect of the present application, in steps I, III and V, the first, second and third pretreatment and drying steps sequentially include 11 processes: washing, pre-degreasing, degreasing, washing, acid pickling, washing, passivation, washing, closing, washing and drying; an electrostatic powder gun is adopted for spraying body powder in step II, the distance between the electrostatic powder gun and the surface of the wheel is 200 mm, the throughput of the electrostatic powder gun is 2.5 $m^3$/h, the atomizing pressure is 3.0 bar, the electrostatic pressure is controlled at 50 KV, the front spray thickness is 120 μm, the body powder curing temperature is 175° C., and the holding time is 25 min; an air spray gun is adopted for spraying paint in step II, the distance between the air spray gun and the surface of the wheel is 180 mm, the throughput of the air spray gun is 60 cc/min, the atomizing pressure is 2.0 bar, the sector pressure is 2.0 bar, the paint spray thickness is 10 μm, the temperature of the wheel workpiece is 40-50° C., the paint curing temperature is 145° C., and the holding time is 25 min; in edging color register spraying of step IV, the injection needle has a caliber of 1.5 mm, the hub is horizontally placed on an automatic rotary table, the needle is fixed on an adjustable bracket, the paint supply system is closed, the distance between the needle and the sprayed surface of the wheel is 4 mm, the flow rate of the injected paint is 10 cc/min, the power of the automatic rotary table is 56.6 Hz, and the air pressure of the closed paint supply system is 2.0 bar; electrostatic spraying is adopted in the high-gloss transparent powder spraying process of step VI, the distance between the electrostatic powder gun and the surface of the wheel is 200 mm, the throughput of the electrostatic powder gun is 2.5 $m^3$/h, the atomizing pressure is 1.5 bar, the electrostatic pressure is 40 KV, the front spray thickness is about 80 μm, the transparent powder curing temperature is 177° C., and the holding time is 22 min.

In a preferred aspect of the present application, in steps I, III and V, the first, second and third pretreatment and drying steps sequentially include 11 processes: washing, pre-degreasing, degreasing, washing, acid pickling, washing, passivation, washing, closing, washing and drying; an electrostatic powder gun is adopted for spraying body powder in step II, the distance between the electrostatic powder gun and the surface of the wheel is 300 mm, the throughput of the electrostatic powder gun is 4.5 $m^3$/h, the atomizing pressure is 4.0 bar, the electrostatic pressure is controlled at 70 KV, the front spray thickness is 160 μm, the body powder curing temperature is 185° C., and the holding time is 20 min; an air spray gun is adopted for spraying a paint in step II, the distance between the air gun and the surface of the wheel is 250 mm, the throughput of the air spray gun is 100 cc/min, the atomizing pressure is 3.0 bar, the sector pressure is 3.0 bar, the paint spray thickness is 20 μm, the temperature of the wheel workpiece is 40-50° C., the paint curing temperature is 150° C., and the holding time is 15 min; in edging color register spraying of step IV, the injection needle has a caliber of 1.5 mm, the hub is horizontally placed on an automatic rotary table, the needle is fixed on an adjustable bracket, the paint supply system is closed, the distance between the needle and the sprayed surface of the wheel is 6 mm, the flow rate of the injected paint is 20 cc/min, the power of the automatic rotary table is 56.6 Hz, and the air pressure of the closed paint supply system is 3.0 bar; electrostatic spraying is adopted in the high-gloss transparent powder spraying process of step VI, the distance between the electrostatic powder gun and the surface of the wheel is 300 mm, the throughput of the electrostatic powder gun is 3.5 $m^3$/h, the atomizing pressure is 2.5 bar, the electrostatic pressure is 60 KV, the front spray thickness is about 120 μm, the transparent powder curing temperature is 180° C., and the holding time is 15 min.

In a preferred aspect of the present application, step VI further includes the step of ultrasonic treatment, ultrasonic waves are applied to the wheel in a pulsed manner, each pulse lasts for 0.7 s, and the energy density of the ultrasonic wave is 120-400 W/$cm^2$.

The present application discloses a spraying color register process, and the specific process flow is: pretreatment-drying-body powder spraying-paint spraying-curing-pretreatment-drying-edging color register spraying-curing-pretreatment-drying-high-gloss transparent powder spraying-curing. The present application forms grooves mainly by milling on the visible surface of the rim, color register spraying is performed by needle injection, and a clear contour is finally obtained. The color register part may present different colors according to customer's needs, and colorful rings are added on the basis of original color of the surface of the hub, so that the appearance is attractive and novel. The present application breaks the conventional shielded protective color register process, the designed grooves may be in a full circle or partial, meanwhile, the size of the grooves may also be changed, and the appearance effect finally shows the personality of the times and full dynamics. The edge of the surface produced by the method of the present application is neat and the coating has high fastness.

DETAILED DESCRIPTION OF THE INVENTION

Embodiment 1

In a preferred aspect of the present application, in steps I, III and V, the first, second and third pretreatment and drying steps sequentially include 11 processes: washing, pre-degreasing, degreasing, washing, acid pickling, washing, passivation, washing, closing, washing and drying; an electrostatic powder gun is adopted for spraying body powder in step II, the distance between the electrostatic powder gun and the surface of a wheel is 200 mm, the throughput of the electrostatic powder gun is 2.5 $m^3$/h, the atomizing pressure is 3.0 bar, the electrostatic pressure is controlled at 50 KV, the front spray thickness is 120 μm, the body powder curing temperature is 175° C., and the holding time is 25 min; an air spray gun is adopted for spraying paint in step II, the distance between the air spray gun and the surface of the wheel is 180 mm, the throughput of the air spray gun is 60 cc/min, the atomizing pressure is 2.0 bar, the sector pressure is 2.0 bar, the paint spray thickness is 10 μm, the temperature of the wheel workpiece is 40-50° C., the paint curing temperature is 145° C., and the holding time is 25 min; in edging color register spraying of step IV, the injection needle has a caliber of 1.5 mm, the hub is horizontally placed on an automatic rotary table, the needle is fixed on an adjustable bracket, a paint supply system is closed, the distance between the needle and the sprayed surface of the wheel is 4 mm, the flow rate of the injected paint is 10 cc/min, the power of the automatic rotary table is 56.6 Hz, and the air pressure of the closed paint supply system is 2.0 bar; electrostatic spraying is adopted in the high-gloss transparent powder spraying process of step VI, the distance between the electrostatic powder gun and the surface of the wheel is 200 mm, the throughput of the electrostatic powder gun is 2.5 $m^3$/h, the atomizing pressure is 1.5 bar, the electrostatic pressure is 40 KV, the front spray thickness is about 80 μm, the transparent powder curing temperature is 177° C., and the holding time is 22 min.

Embodiment 2

In steps I, III and V, the first, second and third pretreatment and drying steps sequentially include 11 processes: washing, pre-degreasing, degreasing, washing, acid pickling, washing, passivation, washing, closing, washing and drying; an electrostatic gun is adopted for spraying body powder in step II, the distance between the electrostatic powder gun and the surface of a wheel is 300 mm, the throughput of the electrostatic powder gun is 4.5 $m^3$/h, the atomizing pressure is 4.0 bar, the electrostatic pressure is controlled at 70 KV, the front spray thickness is 160 μm, the body powder curing temperature is 185° C., and the holding time is 20 min; an air spray gun is adopted for spraying a paint in step II, the distance between the air spray gun and the surface of the wheel is 250 mm, the throughput of the air spray gun is 100 cc/min, the atomizing pressure is 3.0 bar, the sector pressure is 3.0 bar, the paint spray thickness is 20 μm, the temperature of the wheel workpiece is 40-50° C., the paint curing temperature is 150° C., and the holding time is 15 min; in edging color register spraying of step IV, the injection needle has a caliber of 1.5 mm, the hub is horizontally placed on an automatic rotary table, the needle is fixed on an adjustable bracket, a paint supply system is closed, the distance between the needle and the sprayed surface of the wheel is 6 mm, the flow rate of the injected paint is 20 cc/min, the power of the automatic rotary table is 56.6 Hz, and the air pressure of the closed paint supply system is 3.0 bar; electrostatic spraying is adopted in the high-gloss transparent powder spraying process of step VI, the distance between the electrostatic powder gun and the surface of the wheel is 300 mm, the throughput of the electrostatic powder gun is 3.5 $m^3$/h, the atomizing pressure is 2.5 bar, the electrostatic pressure is 60 KV, the front spray thickness is about 120 μm, the transparent powder curing temperature is 180° C., and the holding time is 15 min.

Embodiment 3

The condition of each step in this embodiment is substantially the same as that in Embodiment 1, except that step VI further includes the step of ultrasonic treatment, ultrasonic waves are applied to the wheel in a pulsed manner, each pulse lasts for 0.7 s, and the energy density of the ultrasonic wave is 400 W/cm$^2$.

Embodiment 4

The condition of each step in this embodiment is substantially the same as that in Embodiment 1, except that step VI further includes the step of ultrasonic treatment, ultrasonic waves are applied to the wheel in a pulsed manner, each pulse lasts for 0.7 s, and the energy density of the ultrasonic wave is 120 W/cm$^2$.

Embodiment 5

The condition of each step in this embodiment is substantially the same as that in Embodiment 1, except that step VI further includes the step of ultrasonic treatment, ultrasonic waves are applied to the wheel in a pulsed manner, each pulse lasts for 0.7 s, and the energy density of the ultrasonic wave is 240 W/cm$^2$.

Comparative Example 1

The condition of each step in this embodiment is substantially the same as that in Embodiment 1, except that a spray gun is used for spraying paint at a small flow rate and a low angle in step IV, the distance between the spray head and the sprayed surface of the wheel is 6 mm, the flow rate of the injected paint is 20 cc/min, the power of the automatic rotary table is 56.6 Hz, and the air pressure of a closed paint supply system is 3.0 bar.

Embodiment 6

Edged products having bright color and sprayed uniformly are obtained from Embodiments 1-5 and Comparative Example 1.

First, the edge of the edged area of the product of each embodiment or the comparative example is observed with a magnifying glass. The edged area of the product of each embodiment or the comparative example is observed under an 8, magnifying glass, and the numbers of edge splashing points and edge protruding points within 5 cm are calculated. The edge splashing points are calculated as 3 scores, and the edge protruding points are calculated as 1 score. Five samples of the edged area of each product are counted and averaged. The results are shown in Table 1.

TABLE 1

Edge characteristic test of Embodiments 1-5 and Comparative Example 1

| Group No. | Edging defect integral |
|---|---|
| Embodiment 1 | 1.6 |
| Embodiment 2 | 1.2 |
| Embodiment 3 | 0.6 |
| Embodiment 4 | 0.6 |

TABLE 1-continued

Edge characteristic test of Embodiments 1-5 and Comparative Example 1

| Group No. | Edging defect integral |
|---|---|
| Embodiment 5 | 0.4 |
| Comparative example 1 | 5.8 |

It can be seen from the above statistical results that the edge defects are greatly reduced by replacing the nozzle with a syringe. In addition, the applicant also pleasantly surprised to find that the edge defects were further reduced by ultrasonic treatment.

Embodiment 7

Fastness test is performed on the edged product of Embodiments 1-5 and Comparative Example 1. The specific method is to scribe 11 parallel lines every interval 2 mm using a paper knife on a sample of each edged product, and then scribe parallel 11 lines every interval 2 mm in the vertical direction to deeply reach a metal layer. Then, a transparent tape is adhered to the drawn area, and then light pressing to make stick fast. After 5 min, the transparent tape is torn, and the number of the damaged or peeled part in 10*10 grids is calculated. The test is carried out five times and the average value is taken, and the test results are shown in Table 2.

TABLE 2 scribe test results of Embodiments 1-5 and Comparative Example 1

| Group No. | Average number of edging defects |
|---|---|
| Embodiment 1 | 2.4 |
| Embodiment 2 | 1.8 |
| Embodiment 3 | 0.8 |
| Embodiment 4 | 0.6 |
| Embodiment 5 | 1.0 |
| Comparative example 1 | 7.6 |

It can also be seen from the above statistical results that the edge defects are greatly reduced by replacing the nozzle with a syringe. In addition, the applicant also pleasantly surprised to find that the edge defects were further reduced by ultrasonic treatment.

The foregoing descriptions of specific exemplary embodiments of the present application have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A color register edging method for an aluminum alloy hub, comprising the following steps: (I) a first pretreatment and drying step, including washing, degreasing, acid pickling and passivation; (II) a body powder spraying and a paint spraying and respective curing steps; (III) a second pretreatment and drying step, including washing, degreasing, acid pickling and passivation; (IV) an edging color register applying and curing step, wherein a color register paint is squeezed onto a surface that needs color register by using an injection needle; (V) a third pretreatment and drying step, including washing, degreasing, acid pickling and passivation; and (VI) a transparent powder spraying and curing step.

2. The method according to claim 1, wherein in steps I, III and V, the first, second and third pretreatment and drying steps sequentially include the processes of: washing, pre-degreasing, degreasing, washing, acid pickling, washing, passivation, washing, closing, washing and drying.

3. The method according to claim 1, wherein in step II, an electrostatic powder gun is adopted for spraying body powder, a distance between the electrostatic powder gun and a surface of a wheel is 200-300 mm, a throughput of the electrostatic powder gun is 2.5-4.5 $m^3$/h, an atomizing pressure is 3.0-4.0 bar, an electrostatic pressure is controlled at 50-70 KV, a body powder spray thickness is 120-160 μm, a body powder curing temperature is 175-185° C., and a holding time is 20-25 min.

4. The method according to claim 1, wherein in step II, an air gun is adopted for spraying paint, a distance between the air spray gun and a surface of a wheel is 180-250 mm, a throughput of the air spray gun is 60-100 mL/min, an atomizing pressure is 2.0-3.0 bar, a sector pressure is 2.0-3.0 bar, a paint spray thickness is 10-20 pm, a temperature of the wheel is 40-50° C., a paint curing temperature is 145-150° C., and a holding time is 15-25 min.

5. The method according to claim 1, wherein in edging color register spraying of step IV, the injection needle has a caliber of 1.5 mm, the hub is horizontally placed on an automatic rotary table, and the needle is fixed on an adjustable bracket.

6. The method according to claim 5, wherein a distance between the needle and a sprayed surface of a wheel is 4-6 mm, a flow rate of the injected paint is 10-20 mL/min, a power of the automatic rotary table is 56.6 Hz, a closed paint supply system is used to supply paint, and an air pressure of the dosed paint supply system is 2.0-3.0 bar.

7. The method according to claim 1, wherein in step VI, an electrostatic spraying is adopted in the transparent powder spraying process, an electrostatic power gun is used to spray the transparent powder, a distance between the electrostatic powder gun and a surface of a wheel is 200-300 mm, a throughput of the electrostatic powder gun is 2.5-3.5 $m^3$/h, an atomizing pressure is 1.5-2.5 bar, an electrostatic pressure is controlled at 40-60 KV, a transparent powder spray thickness is about 80-120 pm, a transparent powder curing temperature is 177-180° C., and a holding time is 15-22 min.

8. The method according to claim 1, wherein, in steps I, Ill and V, the first, second and third pretreatment and drying steps sequentially include 11 processes: washing, pre-degreasing, degreasing, washing, acid pickling, washing, passivation, washing, closing, washing and drying; an electrostatic powder gun is adopted for spraying body powder in step II, a distance between the electrostatic powder gun and a surface of a wheel is 200 mm, a throughput of the electrostatic powder gun is 2.5 $m^3$/h, an atomizing pressure is 3.0 bar, an electrostatic pressure is controlled at 50 KV, a body powder spray thickness is 120 μm, a body powder curing temperature is 175° C., and a holding time is 25 min; an air gun is adopted for spraying paint in step II, a distance between the air spray gun and the surface of the wheel is 180 mm, a throughput of the air spray gun is 60 cc/min, an atomizing pressure is 2.0 bar, a sector pressure is 2.0 bar, a paint spray thickness is 10 pm, a temperature of the wheel is 40-50° C., a paint curing temperature is 145° C., and a holding time is 25 min; in edging color register spraying of step IV, the injection needle has a caliber of 1.5 mm, the hub is horizontally placed on an automatic rotary table, the needle is fixed on an adjustable bracket, a paint supply system used to supply paint is closed, a distance between the needle and the sprayed surface of the wheel is 4 mm, a flow rate of the injected paint is 10 cc/min, a power of the automatic rotary table is 56.6 Hz, and an air pressure of the closed paint supply system is 2.0 bar; electrostatic spraying is adopted in the transparent powder spraying process of step VI, a distance between the electrostatic powder gun and the surface of the wheel is 200 mm, a throughput of the electrostatic powder gun is 2.5 $m^3$/h, an atomizing pressure is 1.5 bar, an electrostatic pressure is 40 KV, a transparent powder spray thickness is about 80 pm, a transparent powder curing temperature is 177° C., and a holding time is 22 min.

9. The method according to claim 1, wherein in steps I, Ill and V, the first, the second and the third pretreatment and drying steps sequentially include 11 processes: washing, pre-degreasing, degreasing, washing, acid pickling, washing, passivation, washing, closing, washing and drying; an electrostatic gun is adopted for spraying body powder in step II, a distance between the electrostatic powder gun and a surface of a wheel is 300 mm, a throughput of the electrostatic powder gun is 4.5 $m^3$/h, an atomizing pressure is 4.0 bar, an electrostatic pressure is controlled at 70 KV, a body powder spray thickness is 160 μm, a body powder curing temperature is 185° C., and a holding time is 20 min; an air spray gun is adopted for spraying paint in step II, a distance between the air gun and the surface of the wheel is 250 mm, a throughput of the air spray gun is 100 cc/min, an atomizing pressure is 3.0 bar, a sector pressure is 3.0 bar, a paint spray thickness is 20 pm, a temperature of the wheel is 40-50° C., a paint curing temperature is 150° C., and a holding time is 15 min; in edging color register spraying of step IV, the injection needle has a caliber of 1.5 mm, the hub is horizontally placed on an automatic rotary table, the needle is fixed on an adjustable bracket, a paint supply system used to supply paint is closed, a distance between the needle and the sprayed surface of the wheel is 6 mm, a flow rate of the injected paint is 20 cc/min, a power of the automatic rotary table is 56.6 Hz, and an air pressure of the closed paint supply system is 3.0 bar; electrostatic spraying is adopted in the transparent powder spraying process of step VI, a distance between the electrostatic powder gun and the surface of the wheel is 300 mm, a throughput of the electrostatic powder gun is 3.5 $m^3$/h, an atomizing pressure is 2.5 bar, an electrostatic pressure is 60 KV, a transparent powder spray thickness is about 120 pm, a transparent powder curing temperature is 180° C., and a holding time is 15 min.

10. The method according to claim 1, wherein step VI further comprising the step of ultrasonic treatment, ultrasonic waves are applied to a wheel in a pulsed manner, each pulse lasts for 0.7 s, and an energy density of an ultrasonic wave is 120-400 W/$cm^2$.

* * * * *